US007371186B2

(12) United States Patent
Rutherford

(10) Patent No.: US 7,371,186 B2
(45) Date of Patent: May 13, 2008

(54) PUTTING TRAINING AID

(75) Inventor: Charles P. Rutherford, 11435 Kenyon Ct. NE., Blaine, MN (US) 55449

(73) Assignee: Charles P. Rutherford, Blaine, MN (US)

( * ) Notice: Subject to any disclaimer, the term of this patent is extended or adjusted under 35 U.S.C. 154(b) by 0 days.

(21) Appl. No.: 11/420,537

(22) Filed: May 26, 2006

(65) Prior Publication Data

US 2007/0021231 A1 Jan. 25, 2007

Related U.S. Application Data

(60) Provisional application No. 60/685,009, filed on May 26, 2005.

(51) Int. Cl.
*A63B 69/36* (2006.01)
*B41F 17/30* (2006.01)
*B41F 17/00* (2006.01)

(52) U.S. Cl. ..... 473/257; 473/142; 101/35; 101/127

(58) Field of Classification Search ..... 473/139, 473/140, 142, 143–149; 101/35, 127, 129
See application file for complete search history.

(56) References Cited

U.S. PATENT DOCUMENTS

| | | | | |
|---|---|---|---|---|
| 4,336,940 | A * | 6/1982 | Sprague | 473/393 |
| 5,413,348 | A * | 5/1995 | Basso | 473/393 |
| 6,004,223 | A * | 12/1999 | Newcomb | 473/257 |
| 6,676,544 | B2 * | 1/2004 | Tyke | 473/406 |
| 2002/0160845 | A1 * | 10/2002 | Simonsen | 473/139 |

* cited by examiner

*Primary Examiner*—Nini F. Legesse
(74) *Attorney, Agent, or Firm*—Dicke, Billig, & Czaja, P.L.L.C.

(57) ABSTRACT

A putting training aid comprising a main body having a first recess and a second recess formed therein, wherein the first recess is adapted to at least partially receive a golf ball to provide a guide for placing a marking on the golf ball a spindle member operably attached to the main body to at least partially extend into the second recess; and a string wound around the spindle member.

15 Claims, 2 Drawing Sheets

PUTTING TRAINING AID

RELATED APPLICATION

The present application claims the benefit of U.S. Provisional Application No. 60/685,009 filed May 26, 2006, which is incorporated herein in its entirety by reference.

FIELD OF THE INVENTION

The invention generally relates to a golf training aid, to teach and reinforce the ideal putting stroke, in the game of golf. More particularly, the invention is a device that includes both a golf ball alignment system and a golf ball marking system. When used together during a practice putting session, the golf ball alignment line provides a guide to ensure proper alignment of the golf ball to the golf hole, and the marked ball provides instant and accurate feedback to teach and/or reinforce the proper putting stroke.

BACKGROUND OF THE INVENTION

Golf is a game of skill, the goal of which is to complete a round of golf in the fewest strokes possible. Generally, serious golfers are interested in game improvement and lower scores. The basic strokes that make up the game of golf are full shots, pitching, chipping, and putting. Generally, in a round of golf, no matter what course or quality of player, the putter is used for more strokes than any of the 13 other clubs a player may have in the golf club bag. One way for players of any skill level to achieve lower scores is to improve their putting.

To make a good putt, the golf ball should be struck with the putter so as to cause the ball to roll end-over-end. A ball that rolls end-over-end starts on line and stays on line, whereas a putt that is struck with underspin or sidespin rolls with little directional or distance consistency. The player that correctly "reads" the contour and grain of the green, makes proper aim and alignment, strikes the golf ball to impart an end-over-end roll, and hits the putt the proper speed, will generally make more putts.

Typically, prior to making a putt, the golfer inspects or "reads" the green, to determine if the path to the golf hole contains any slopes, undulations, or any other characteristics that need to be considered prior to selecting a target line to the golf hole. Frequently, to compensate for the characteristics of the terrain between the golf ball and the golf hole, the golfer must aim the ball at a point removed from the hole instead of directly at the hole. On other occasions, the golfer can aim the golf ball directly at the hole.

It can be helpful to use a permanent line placed at the golf ball's equator to aim the putt along the selected target line or alignment line. A marked line on the golf ball can assist the golfer in aligning the golf ball with a target line and also aligning the putter club face with a target line. Golf balls may contain some manufacturer markings that assist the golfer in aligning the golf ball with the target line, but these markings may not circumscribe the golf ball and/or may not be easily visible.

In golf, the ideal putt is one where the ball is struck in such a manner as to cause the ball to roll end-over-end. When practice putting, players who apply a line ("the applied line") around the entire equator of the golf ball receive instant and accurate feedback as to the quality of the roll once the ball is struck. If the applied line appears as a solid straight line when the ball is in motion, such a line confirms that the ball is rolling end-over-end. If the applied line wobbles or appears to disappear when the ball is in motion, which is indicative of the ball rolling with some degree of underspin or sidespin.

If the player is practice putting a straight putt, that is to say a putt without any break, the player can align the applied line (the marking circumscribing the ball) of the ball directly with the target line, or into the middle of the golf hole. A target line can be marked on the putting surface, to assist in aligning the golf ball on the target line. The target line can be used to align feet, knees, hips, shoulders and putter face with the target line, to position the golf ball, to determine proper eye position over the ball, and to see if the putter stays "on plane."

There were a number of golf ball marking devices that are designed to provide a mark on the golf ball and thus assist a golfer in improving alignment of the golf ball with the target line and putter head. For example, U.S. Pat. No. 6,324,971 to Urban describes a hollow cylindrical shape with a pin or a peg in the bottom of the cylinder to hold the golf ball. The golf ball is set in the cylinder and the circumference of the golf ball can be marked.

U.S. Pat. No. 6,004,223 to Newcomb discloses a golf ball stencil wherein the stencil is a rigid hemisphere that fits on the golf ball. Two intersecting slits on the hemisphere can be used to mark a cross on the ball.

U.S. Pat. No. 6,216,587 to Foley describes a golf ball-marking device wherein the main body of the marking device forms a resiliently deformable retention cavity that uses friction to secure a golf ball in the cavity. Handles extending from the opposite ends of the main body can be moved together, securing the golf ball in the golf ball marking device. The device allows for marking approximately half the circumference of the golf ball without readjusting the marking device.

U.S. Pat. No. 6,595,128 to Parks describes a golf ball stencil wherein the semi-rigid stencil can be snapped securely around the surface of a golf ball. The golf ball can rotate freely within the stencil to be positioned by the user. Then, a pair of finger grips is compressed to clamp the ball in position while the ball is being marked. Approximately, three quarters of the circumference of the ball can be marked without repositioning the stencil.

In addition, U.S. Pat. No. 6,213,887 to Carney discloses a laser-aiming device for assisting in aligning a golf ball to a practice putting hole. The laser module emitting a laser beam is mounted adjacent the plastic hole and projects a laser beam forward providing an illuminated reference for aligning a putter with respect to the hole.

SUMMARY OF THE INVENTION

In one embodiment, the invention provides for a putting training aid that can be used as a ball marking device to apply a line at the equator of the golf ball, and can also be used to mark a target line on the putting surface to assist in accurate alignment of ball, hole and putter head. The putting training aid comprises a truncated spherical member, wherein the top and the bottom of the spherical member have been flattened and at least the top end of the spherical member is open.

The flattened bottom of the spherical allows for the device to rest on a flat surface without rolling or otherwise moving on its own power from where it was placed. The top of the truncated spherical member includes a hollow recess or bowl with a diameter sized to accept and support a golf ball. The golf ball is seated in the bowl such that the ball circumference is available for marking. A user can place a golf ball in the bowl of the aid and apply an aim line at the equator of the golf ball. The mark can circumscribe the golf ball or the mark can be made on only a section of the golf ball.

The interior of the truncated spherical member is at least partially hollow and includes a spindle. One end of a chalk line string is attached to the spindle and the chalk line string is wound around the spindle. The chalk line string has a ring or tab attached to the free end of the chalk line string. The side of the truncated spherical member contains a small hole through which the chalk line string passes. Among various purposes, the ring or tab allows for easy grasping of the chalk line string, and keeps the chalk line string from being totally enclosed by the truncated spherical member and inaccessible from the exterior of the truncated spherical member.

The interior of the truncated spherical member holds chalk material such that the chalk line string is covered in chalk material. The ring in the end of the chalk line string allows a player to place a golf tee through the ring and secure the ring and line to the practice putting surface centered just beyond the golf hole. The player can walk down the target line 10' to 15' feet holding the putting training aid, allowing the chalk line to unreel. The player can reach down to the putting surface, pull all slack from the chalk line, then press the string from the putting training aid's end to the ground with one hand while reaching down with the other hand to lift the line several inches in the air before releasing it and thereby 'snaps' the chalk line causing the chalk line string to drop chalk on the ground directly below the string. Thus, the selected target line or alignment line has been marked into the middle of the hole, on a straight putt. A similar process can be used when marking a target line to one side of the hole, taking in consideration the break of the putting surface. The chalk line string is rewound into the interior of the truncated spherical member and chalk is reapplied to the chalk line string.

Thus, the putting training aid includes a golf ball marking device that enables a player to place an aim line at the golf ball's equator which, when the ball is struck, provides feedback regarding the quality of the stroke. The putting training aid also includes a way of marking a target line, for example, a chalk line or a laser beam, to ensure proper alignment of the golf ball, hole and putter face.

The invention can be varied in other embodiments, and is not limited to the particular embodiment provided herein.

DETAILED DESCRIPTION OF THE INVENTION

Figures 1, 2:
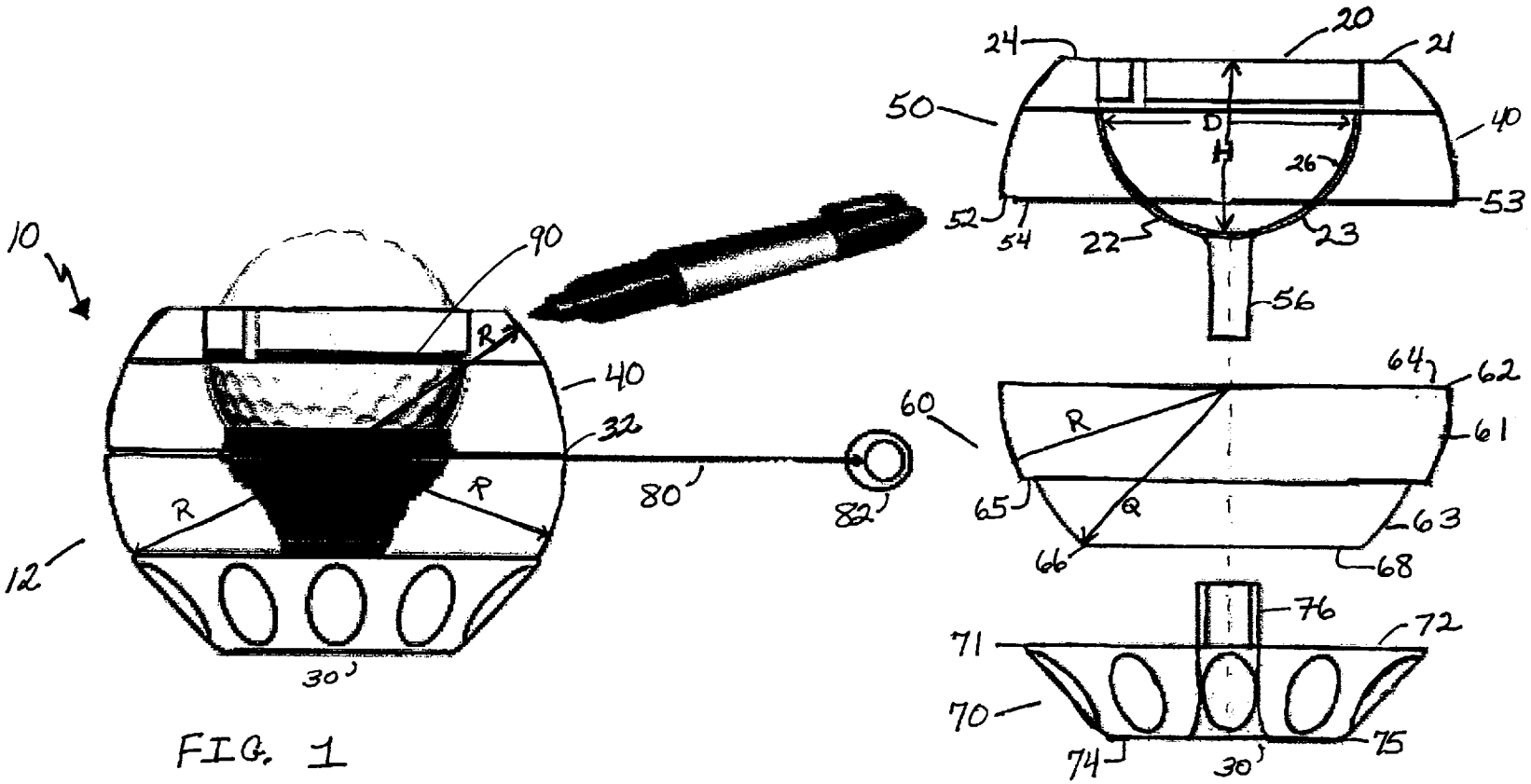
FIG. 1 is a side view of an embodiment of the putting training aid of the invention
FIG. 2 is an exploded view of the putting training aid of the invention.

Referring to FIG. 1, one embodiment of the putting training aid 10 is comprised of a rigid spherical member 12 with spherical radius R that has opposing flat sides. These opposing flat sides form the top or first end 20 and the bottom or second end 30 of spherical member 12, respectively. At least one end, the first end 20, of spherical member 12, is open and has an open end top surface 24. The open end of first end 20 contains a recess or bowl 22 with internal surface 26. Bowl 22 has an internal diameter D that is sized to accept a golf ball. Flattened spherical member 12 has an exterior surface 40 that may be smooth, rough or dimpled.

Referring to FIG. 2, in one embodiment putting training aid 10 is comprised of at least three sections. The three sections 50, 60, 70 of putting training aid 10 compose flattened spherical member 12 and are fitted together. Top section 50 of flattened spherical member 12 contains first end 20, bowl 22, a top surface 24 and a lower surface 52. Diameter 21 of circular top surface 24 of first end 20 is smaller than diameter 53 of lower circular surface 52 of top section 50. Lower surface 52 can include a beveled edge 54 adjacent and extending from lower surface 52.

Bowl 22 of top section 50 has a depth H that is the distance from open end surface 24 of first end 20 to the bottom of bowl 22. Bottom 23 of bowl 22 may protrude beyond lower surface 52 and beveled edge 54 of top section 50. Alternatively, bottom 23 of bowl 22 may be entirely contained within top section 50. Extending from the bottom of bowl 22 is a projection 56. The length L of projection 56 is sufficient to traverse middle section 60 and mate to a hollow or, alternatively, partially hollow protrusion extending from bottom section 70 up towards middle section 60.

Middle section 60 is comprised of two contiguous portions, an upper portion 61 and a lower portion 63. Upper portion 61 of middle section 60 has a circular top surface 64 with diameter 62 similar in length to diameter 53 of lower surface 52 of top section 50. Lower portion 63 of middle section 60 is stepped in from upper portion 61 of middle section 60. Lower portion 63 has a spherical radius Q that is smaller than spherical radius R of upper portion 61 of middle section 60. Smaller spherical radius Q of lower portion 63 allows bottom section 70 to mate with lower portion 63 of middle section 60, such that lower portion 63 of middle section 60 fits into bottom section 70. Spherical radius R of bottom section 70 is equal to spherical radius of upper portion 61 of the middle piece 60. When middle section 60 is mated with bottom section 70, stepped-in surface 65 is proximate top surface 72 of lower section 70. Diameter 68 of lower surface 66 of lower portion 63 is smaller than diameter 62 of top surface 64.

Figure 3:
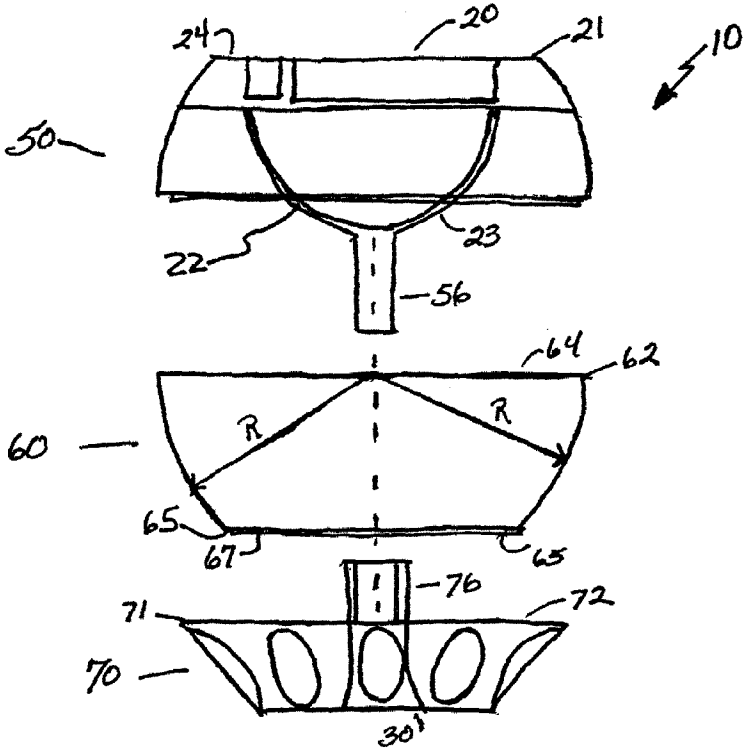
FIG. 3 is an exploded view of another embodiment of the putting training aid of the invention.

Alternatively, middle section 60 can be comprised of a single portion that is not stepped-in and has the same spherical radius R throughout middle section 60, as shown in FIG. 3. Lower surface 65 of middle section 60 has a smaller diameter than top surface 64. A beveled edge 67 is adjacent to and extends from surface 65 and is designed to fit into the top of bottom section 70.

Bottom section 70 has a top surface 72 and a lower surface 74. Diameter 71 of circular top surface 72 is larger than diameter 75 of bottom circular surface 74. When middle portion 60 and bottom section 70 are mated, surface 72 is adjacent to surface 65, and lower portion 63 fits inside of bottom section 70. Bottom section 70 includes a projection 76 that protrudes from the bottom of bottom section 70 up towards top surface 72 of bottom section 70. Projection 76 can be hollow or partially hollow, such that when sections 50, 60, and 70 are mated, projection 56 fits inside of hollow or, alternatively, partially hollow projection 76. The surface of bottom section 70 can be textured to provide for easier gripping of putting training aid 10.

A chalk line string 80 is wound around the spindle formed by the mated projections 56, 76. Chalk line string 80 has a tab, ring or the like 82 attached to the free end of chalk line string 80, while the opposite end of chalk line string 80 is attached to mated projections 56, 76. Side surface 40 of flattened spherical member 12 contains a small orifice 32 through which chalk line string 80 exits the interior of putting training aid 10. Chalk line string 80 can be pulled by ring 82 to expose the desired length of chalk line string 80 exterior to putting training aid 10. When chalk line string 80 is released, it winds itself upon mated projection 56, 76, leaving ring 82 on the exterior of putting training aid 10.

Alternatively, instead of having a chalk line string in the interior of flattened spherical member 12, a laser (not shown) can be included in the putting training aid 10. To accommodate the laser alignment feature, the configuration of the putting training aid may be altered.

Putting training aid 10 may contain a spring assembly (not shown) in its interior, to facilitate winding chalk line string 80 on mated projections 56, 76 once chalk line string 80 is released or "snapped." Alternatively, mated projections 56, 76 are slidably mated, as are middle section 60 and bottom section 70. Thus, projection 76 can turn relative to projection 56 and bottom section 70 can turn relative to middle section 60. Thus, bottom section 70 can be turned to wind chalk line string 80 back onto the spindle formed by the mated projections 56, 76.

The three sections of the putting training aid 50, 60 and 70 are mated to form putting training aid 10. Top section 50 mates with middle section 60, such that surface 52 is proximate surface 64, and beveled edge 54 fits inside middle section 60. Middle section 60 is at least partially hollow, such that projection 56 can pass through section 60 and once mated with projection 76, chalk line string 80 can be wound around the spindle formed by projections 56, 76. In addition, the interior of putting training aid 10 has a compartment surrounding the wound chalk line string 80 containing chalk.

Middle section 60 mates with bottom section 70, such that projection 56 fits into projection 76. In one embodiment, lower portion 63 of middle section 60 fits into bottom section 70, such that edge 72 is proximate edge 66. Hence, when putting training aid is assembled, surface 52 is proximate surface 64 and surface 68 is proximate surface 72, and lower portion 63 fits inside of bottom section 70. In another embodiment, beveled edge 67 is adjacent to and extends from surface 65 and fits into the top of bottom section 70. Thus, lower surface 65 is proximate to surface 72.

Putting training aid 10 is described herein as comprising three sections that are mated to form the putting training aid 10. However, for example, putting aid 10 can be constructed comprising two sections that are mated together to form whole putting training aid 10. Hence, other constructions of putting aid 10 are contemplated and are within the broad scope of the disclosure.

Proximate surface 24 of upper section 50 is a slit 90 that circumscribes bowl 22 at its middle or widest diameter. Slit 90 is located such that when a golf ball in placed in bowl 22, the golf ball circumference is positioned at slit 90. Slit 90 circumscribes bowl 22 such that when a golf ball in placed in bowl 22, slit 90 circumscribes the golf ball. When a golf ball is contained in bowl 22, the tip of a marking device can be inserted into or along slit 90, such that the marking device places a mark on the golf ball. The mark placed on the golf ball can mark only a portion of the golf ball or can circumscribe the golf ball about its middle or equator.

Alternatively, surface 40 of upper section 50 may be devoid of slit 90 and have an uninterrupted surface. In this configuration, when a golf ball is placed in bowl 22, the golf ball circumference is positioned proximate surface 24. Top surface 24 can be used as a guide to mark a line circumscribing the golf ball when the golf ball is positioned in bowl 22. The depth H of bowl 22 is adjusted such that the circumference of the golf ball is positioned proximate surface 24.

Putting training aid 10 can be used to assist a golfer in practicing putting shots. The golf ball is placed in bowl 22 and a marking device is inserted into slit 90. The marking device follows slit 90 around bowl 22, thus marking the circumference of the golf ball at its equator. The golf ball thus marked about its middle or equator provides an aim line with which to line-up the golf ball on the target line. When the golf ball is properly struck, the line drawn on the golf ball will appear as a solid line as the ball rolls. If the ball is not hit perfectly or "true," the line on the ball will appear to wobble and widen. If the ball is struck poorly, the line on the ball may appear to disappear. Hence, the golfer is provided instant feedback as to the quality of the putt, and can adjust the stroke to improve the next putt.

Figure 4:
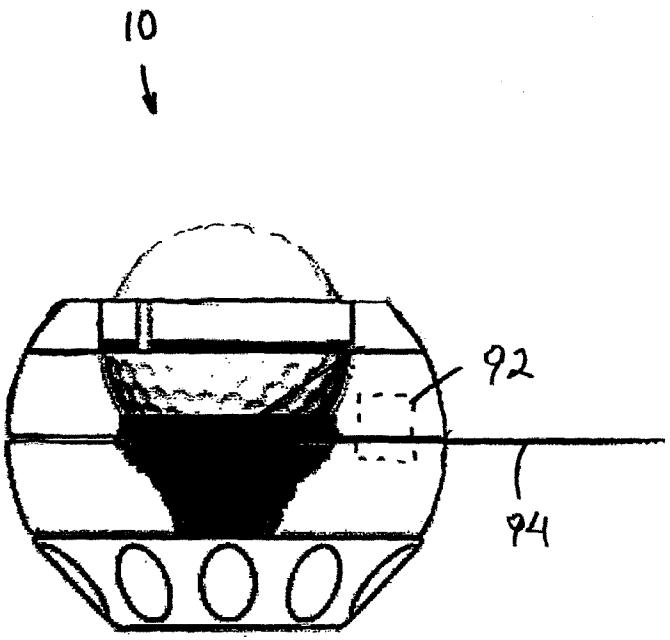
FIG. 4 is aside view of the putting training aid.

However, the cause of a missed putt may be that the golf ball was poorly aligned with the target line. To improve proper alignment to the golf hole the golfer snaps a chalk line on the putting practice surface. The golfer pulls ring 82 on the end of chalk line string 80 and extends chalk line string 80 from the golf ball location to the golf hole. The golfer then releases or "snaps" chalk line string 80, which winds back into the putting training aid and leaves behind a chalk line on the practice putting surface. Now the aim line marked on the ball can be aligned with the chalk line and the practice putt can be taken and evaluated. Alternatively, the target line can be provided by a laser light assembly 92 that is included as a part of the putting training aid 10, as illustrated in FIG. 4. A laser beam emitted by the laser light assembly 92 can be used to provide the target line and the golf ball can be aligned with the laser beam 94. The configuration of the putting training aid 10 can be adjusted to accommodate the laser light assembly 92, and yet retain the golf ball marking feature of the putting training aid 10.

Other embodiments of the putting training aid 10 are contemplated and are included in the scope of the invention. Those skilled in the art will note that other embodiments and modifications of the invention fall within the broad scope and spirit of the foregoing disclosure. The invention is not limited to the particular embodiments provided herein.

The invention claimed is:

1. A putting training aid comprising:

a main body having a first recess and a second recess formed therein, wherein the first recess is adapted to at least partially receive a golf ball to provide a guide for placing a marking on the golf ball, wherein the main body is comprised of a first section, a second section, and a third section;

a spindle member operably attached to the main body to at least partially extend into the second recess, wherein the third section is rotatable relative to the first and second sections such that the rotation of the third section causes the spindle member to rotate; and a string wound around the spindle member.

2. The putting training aid of claim 1, and further comprising an orifice in the main body such that an end of the string can exit the main body and the string can be unwound from the spindle member.

3. The putting training aid of claim 1, wherein the spindle member is rotatable with respect to the main body.

4. The putting training aid of claim 3, wherein the spindle member includes a plurality of surface indentations to facilitate the gripping and rotation of the second section by a user.

5. The putting training aid of claim 1, wherein the first section comprises a first projection, the third section comprises a second projection wherein the first projection traverses the second section and is operably connected to the second projection to form the spindle.

6. The putting training aid of claim 5, wherein the second section is comprised of a first portion including a first spherical radius and a second portion including a second spherical radius, the third section comprises a third spherical radius wherein the second spherical radius is smaller than the first and third spherical radii facilitating the coupling of the second and third sections.

7. The putting training aid of claim 1, further comprising a ring attached to an end of the string.

8. The putting training aid of claim 1, wherein the main body includes a slit that circumscribes the first recess at a widest diameter such that when a golf ball is received by the first recess, a marking device can be inserted into or along the slit, placing a mark on the golf ball.

9. The putting training aid of claim 8, wherein the slit is such that a marking device can be inserted into or along the slit to circumscribe and mark the golf ball about its middle.

10. The putting training aid of claim 1, wherein the string is a chalk line string.

11. A method of teaching a person to hit a golf ball, the method comprising:

providing a putting training aid comprising a main body, a spindle member and a string, wherein the main body has a first recess and a second recess, wherein the spindle member is operably attached to the main body to at least partially extend into the second recess, and wherein the string is wound around the spindle member;

placing a golf ball at least partially into the first recess;

marking the golf ball using the putting training aid as a guide; and extending the string from the main body to identify an intended path for the golf ball.

12. The method of claim 11, wherein the string is a chalk line string and the method further comprises anchoring an end of the string, lifting and releasing the string thereby marking the intended path for the golf ball upon a putting surface.

13. The method of claim 11 further comprising:

placing the golf ball on a putting surface such that a plane substantially intersecting the middle of the golf ball and a mark on the golf ball is substantially perpendicular to the putting surface;

hitting the golf ball; and observing the mark on the golf ball while the golf ball is in motion.

14. The method of claim 11, further comprising winding the string onto the spindle by rotating the spindle member.

15. The method of claim 11, wherein the main body includes a guiding slit, and marking the golf ball using the putting training aid as a guide comprises the steps of:

inserting a marking device into the guiding slit;

circumscribing the outside surface of the golf ball with the marking device.

* * * * *